US009833993B2

(12) United States Patent
Satomi

(10) Patent No.: US 9,833,993 B2
(45) Date of Patent: Dec. 5, 2017

(54) INK JET HEAD AND MANUFACTURING METHOD THEREOF

(71) Applicant: TOSHIBA TEC KABUSHIKI KAISHA, Tokyo (JP)

(72) Inventor: Masayuki Satomi, Nagaizumi Sunto Shizuoka (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/199,372

(22) Filed: Jun. 30, 2016

(65) Prior Publication Data

US 2017/0008286 A1 Jan. 12, 2017

(30) Foreign Application Priority Data

Jul. 9, 2015 (JP) ..... 2015-137736

(51) Int. Cl.
*B41J 2/14* (2006.01)
*B41J 2/16* (2006.01)

(52) U.S. Cl.
CPC ..... *B41J 2/14233* (2013.01); *B41J 2/161* (2013.01); *B41J 2/1628* (2013.01); *B41J 2/1629* (2013.01); *B41J 2/1634* (2013.01); *B41J 2/1642* (2013.01); *B41J 2/1646* (2013.01); *B41J 2002/1437* (2013.01); *B41J 2002/14491* (2013.01)

(58) Field of Classification Search
CPC ..... B41J 2/14201; B41J 2/14233
See application file for complete search history.

(56) References Cited

U.S. PATENT DOCUMENTS

| | | | | |
|---|---|---|---|---|
| 6,584,660 | B1 * | 7/2003 | Shimogawa | B41J 2/14233 219/121.69 |
| 7,101,026 | B2 | 9/2006 | Shimada et al. | |
| 7,651,201 | B2 | 1/2010 | Shimada et al. | |
| 2010/0141712 | A1 * | 6/2010 | Kim | B41J 2/161 347/68 |

FOREIGN PATENT DOCUMENTS

| | | | |
|---|---|---|---|
| JP | 2000094688 | A | 4/2000 |

* cited by examiner

*Primary Examiner* — Geoffrey Mruk
(74) *Attorney, Agent, or Firm* — Patterson & Sheridan, LLP

(57) ABSTRACT

An ink jet head includes a base member having a plurality of openings, a diaphragm formed on a surface of the base member covering each of the openings, a pressure chamber being formed at each of the openings, and a plurality of piezoelectric elements formed at locations on the diaphragm corresponding to the pressure chambers, each of the piezoelectric elements being configured to eject liquid from a corresponding pressure chamber by causing deformation of the diaphragm. The diaphragm includes a plurality of stress release portions that reduces compressive residual stress in the diaphragm, each of the stress release portions corresponding to one of the piezoelectric elements.

20 Claims, 18 Drawing Sheets

INK JET HEAD AND MANUFACTURING METHOD THEREOF

CROSS-REFERENCE TO RELATED APPLICATION

This application is based upon and claims the benefit of priority from Japanese Patent Application No. 2015-137736, filed Jul. 9, 2015, the entire contents of which are incorporated herein by reference.

FIELD

Embodiments described herein relate generally to an ink jet head and a manufacturing method thereof.

BACKGROUND

Generally, an ink jet head of one type has an actuator including a diaphragm and a plurality of piezoelectric elements to eject ink from a plurality of pressure chambers. In such an ink jet head, the diaphragm is deformed by a piezoelectric element to pressurize ink inside a corresponding pressure chamber, and then the ink is ejected.

Depending on a method to form the actuator, especially when using photolithography, compressive stress may remain in the diaphragm of the actuator.

When the compressive stress in the diaphragm is excessively great, upon driving of the actuator, the actuator may undergo buckling distortion due to the compressive stress of the diaphragm. When there is variation in the compressive stress of the diaphragms among the plurality of actuators, the degree of buckling distortion may differ among the actuators, which lead to uneven deformation characteristics among the actuators. As a result, the ink ejection characteristics may become uneven. Also, durability of the actuators may decrease due to the buckling distortion.

DESCRIPTION OF THE DRAWINGS

FIGS. 6A-12A, 6B-12B, and 6C-12C are cross-sectional diagrams of a portion of the inkjet head of FIG. 4 taken along an A-A line, a B-B line, and a C-C line, respectively, at different manufacturing stages.

FIGS. 17A-23A and 17B-23B are cross-sectional diagrams of a portion of the ink jet head of FIG. 15 taken along the D-D line, and the E-E line, respectively, at different manufacturing stages.

DETAILED DESCRIPTION

One or more embodiments provide an ink jet head and a manufacturing method thereof capable of releasing the compressive stress of diaphragms and suppressing or reducing the buckling distortion of actuators when the actuators are driven, capable of making the deformation characteristics among the actuators to be more uniform and the ink ejection characteristics to be more uniform, and capable of preventing damage to the actuators.

In general, according to an embodiment, an ink jet head includes a base member having a plurality of openings, a diaphragm formed on a surface of the base member covering each of the openings, a pressure chamber being formed at each of the openings, and a plurality of piezoelectric elements formed at locations on the diaphragm corresponding to the pressure chambers, each of the piezoelectric elements being configured to eject liquid from a corresponding pressure chamber by causing deformation of the diaphragm. The diaphragm includes a plurality of stress release portions that reduces compressive residual stress in the diaphragm, each of the stress release portions corresponding to one of the piezoelectric elements.

First Embodiment

FIGS. 1 to 12C illustrate an ink jet head according to a first embodiment.

Structure of Ink Jet Head

Figure 1:
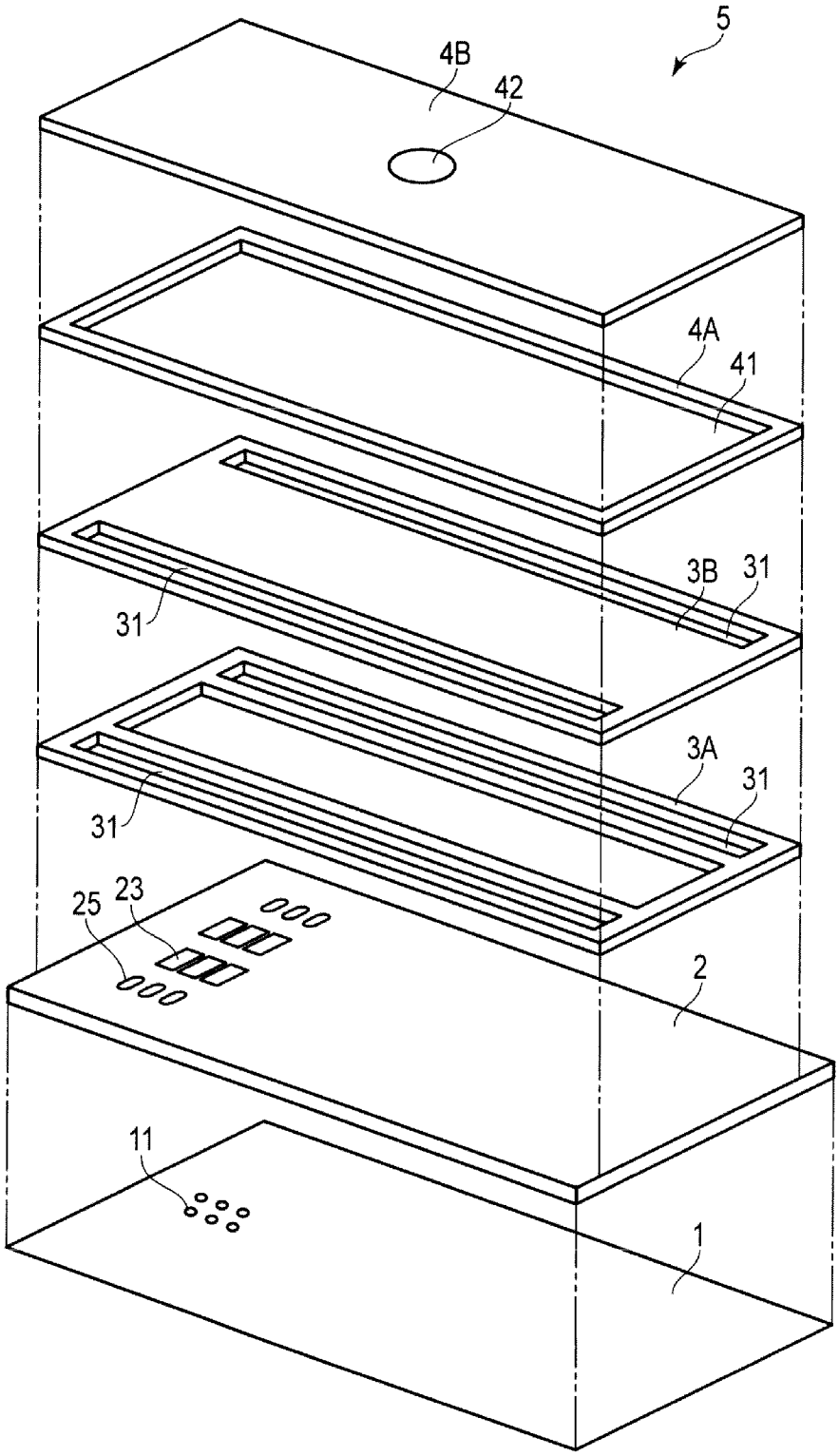
FIG. 1 is an exploded perspective view of an ink jet head according to a first embodiment.
Figure 2:
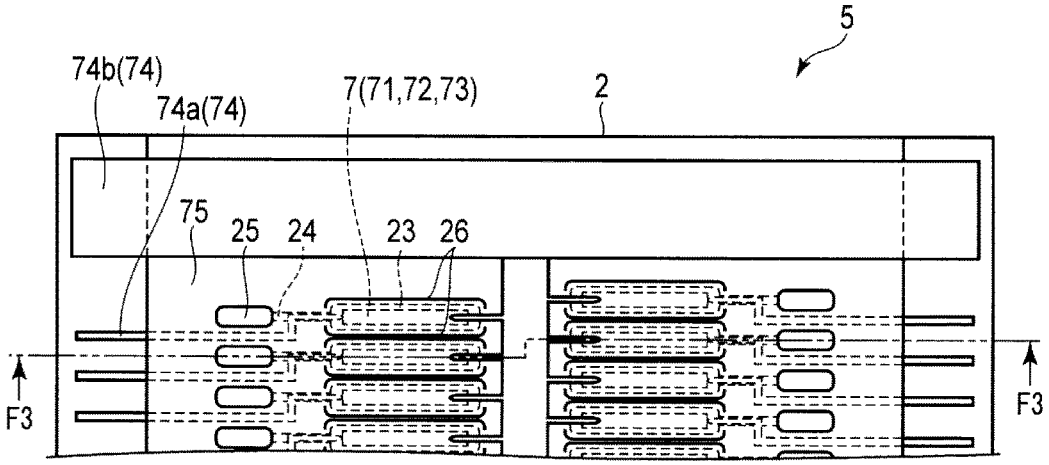
FIG. 2 is a plan view of an end portion of a pressure chamber plate of the ink jet head according to the first embodiment.

Hereinafter, a structure of an ink jet head 5 according to the first embodiment will be described. FIG. 1 is an exploded perspective view of the ink jet head 5, FIG. 2 is a plan view of an end portion of a pressure chamber plate 2 of the ink jet head 5, and FIG. 3 is a cross-sectional view of the ink jet head 5 taken along line F3-F3 of FIG. 2.

As illustrated in FIG. 1, the ink jet head 5 according to the present embodiment has a structure in which a nozzle plate 1, the pressure chamber plate 2, ink supply plates 3A and 3B, and reservoir plates 4A and 4B are stacked together. In the present embodiment, the stack of these elements is formed such that a plan shape of each element as viewed from above is rectangular.

Figure 3:
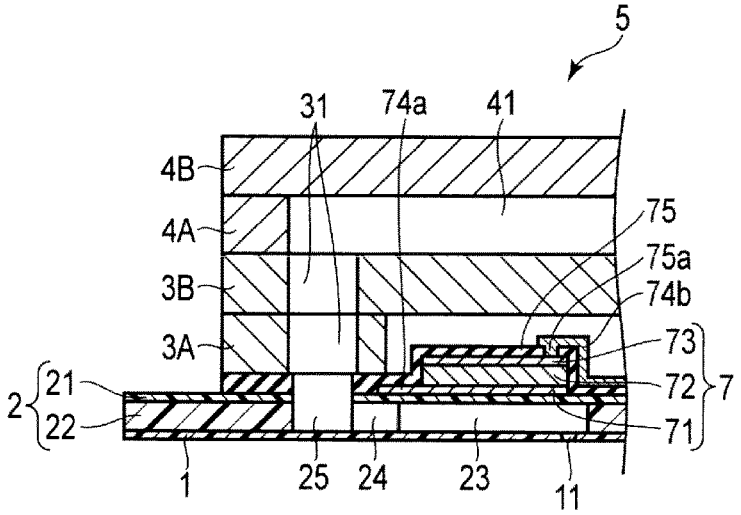
FIG. 3 is a cross-sectional view of the ink jet head of FIG. 2 taken along line F3-F3.

As illustrated in FIG. 3, the pressure chamber plate 2 includes a silicon substrate (base member) 22 which is covered with a diaphragm 21 of silicon (Si) thermal oxide. A plurality of pressure chambers 23, paths 24, and ink supply chambers 25 are formed in the inner portion of the pressure chamber plate 2. As illustrated in FIG. 1, the plurality of pressure chambers 23 is formed to have a rectangular plan shape when viewed from above. In the present embodiment, two rows of pressure chambers 23 are arranged in a short direction of the rectangular pressure chamber plate 2. The plurality of the pressure chambers 23 is formed in the longitudinal direction in each row of the pressure chambers 23.

Normally, the thickness of the pressure chamber plate 2 is 50 μm to 500 μm, and the thickness of the silicon thermal oxide film is 0.2 μm to 10 μm. For the diaphragm 21, a zirconium oxide film, an iridium oxide film, a ruthenium oxide film, or the like may be used instead of a silicon thermal oxide film. For example, when the zirconium oxide film is used, it is possible to form the zirconium oxide film by thermally oxidizing a zirconium film after the zirconium film is formed on the silicon substrate 22 by sputtering.

Openings of the pressure chambers 23 are formed on a side of the pressure chamber plate 2 that is opposite to a side of the pressure chamber plate 2 covered with the diaphragm 21. The nozzle plate 1 is adhered to the side of the pressure chamber plate 2 with the openings. Nozzles 11 are formed in the nozzle plate 1 corresponding to the pressure chambers 23. A polyimide is an example of the material of the nozzle plate 1, and the nozzles 11 of the nozzle plate 1 may be formed by laser machining.

Piezoelectric elements 7 are disposed on positions of the diaphragm 21 corresponding to the pressure chambers 23. The piezoelectric element 7 has a structure in which a bottom electrode 71, a piezoelectric material 72, and a top electrode 73 are stacked together.

On the side of the pressure chamber plate 2 that has the piezoelectric element 7, ink supply plates 3A and 3B and reservoir plates 4A and 4B are stacked via an epoxy adhesive, for example. An ink supply path 31 to communicate with the ink supply chamber 25 is formed in the ink supply plates 3A and 3B. A reservoir 41 connected to the ink supply path 31 is formed in the reservoir plate 4A. An ink inlet 42 for supplying the ink to the reservoir 41 is formed in the reservoir plate 4B.

For the materials of the ink supply plates 3A and 3B, and the reservoir plates 4A and 4B, alumina, zirconia, silicon carbide, silicon nitride, barium titanate, and the like are examples of ceramic materials. Stainless steel, aluminum, titanium, and the like are examples of metal materials. ABS, polyacetal, polyamide, polycarbonate, polyether sulfone, and the like are examples of resin materials.

As illustrated in FIGS. 2 and 3, the bottom electrode 71 is connected to individual wiring 74*a*, which extends to the end portion of the pressure chamber plate 2. The top electrode 73 is connected to common wiring 74*b* via an opening 75*b* of an insulating film 75 of silicon oxide, and the common wiring 74*b* also extends to the end portion of the pressure chamber plate 2. A wiring 74 which includes the individual wiring 74*a* and the common wiring 74*b* is connected to connection terminals of a drive circuit section (not illustrated) at the end portion of the pressure chamber plate 2.

Figure 4:
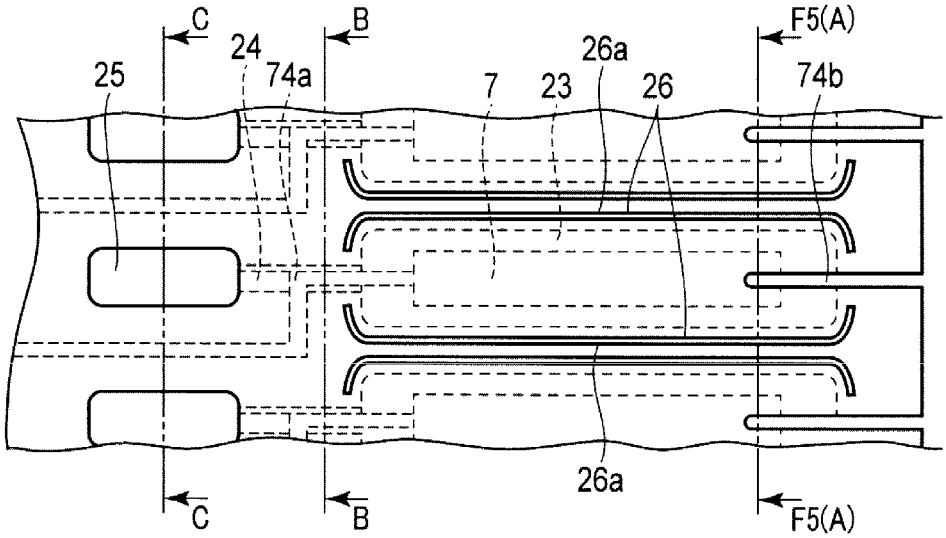
FIG. 4 is an enlarged plan view of a pressure chamber of the ink jet head shown in FIG. 2.
Figure 5:
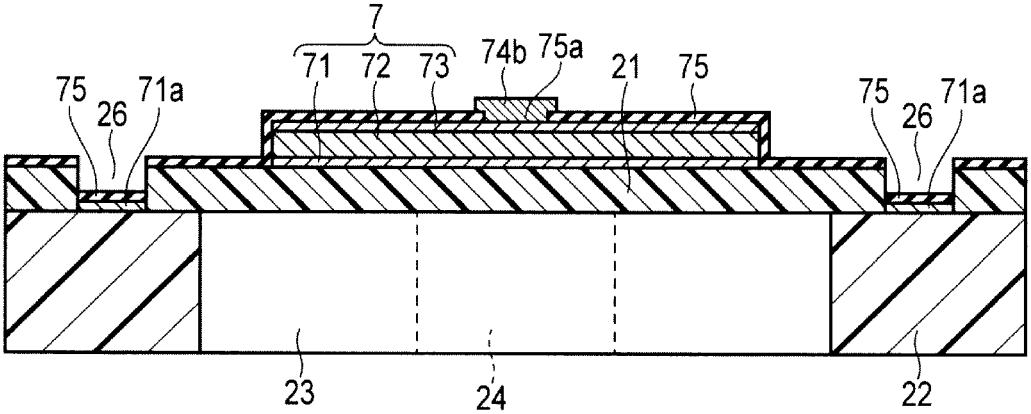
FIG. 5 is a cross-sectional view of the ink jet head of FIG. 4 taken along line F5-F5.

FIG. 4 is an enlarged plan view of a pressure chamber 23 of FIG. 2, and FIG. 5 is a cross-sectional view of the pressure chamber 23 taken along line F5-F5 of FIG. 4. As illustrated in FIGS. 4 and 5, stress release sections 26 for releasing and reducing compressive stress of the diaphragm 21 are formed in a region of the diaphragm 21 which does not face the pressure chamber 23. In the present embodiment, the region which does not face the pressure chamber 23 is a region outside the pressure chamber 23, surrounding the pressure chamber 23, and excluding the portion corresponding to the constricting path 24 and the wiring 74. A pair of through holes (removed sections) 26*a* having a groove shape (slit shape) are formed alongside portions of the pressure chamber 23 in a region surrounding the pressure chamber 23 in the stress release section 26. For each of the piezoelectric elements 7, a pair of through holes 26*a* is formed in the same shape with respect to each of the piezoelectric elements 7. Here, a pull-out position and a pull-out direction of the wiring 74 in relation to each of the piezoelectric elements 7 are matched such that it is easy to render the shape of each of the through holes 26*a* corresponding to each of the piezoelectric elements 7 to be the same shape.

Manufacture of Pressure Chamber Plate 2 and Piezoelectric Element 7

Hereinafter, a manufacturing process of the pressure chamber plate 2 and the piezoelectric element 7 will be described. FIGS. 6A, 7A, 8A, 9A, and 10A are cross-sectional diagrams of the pressure chamber plate 2 taken along the A-A line of FIG. 4. Similarly, FIGS. 6B, 7B, 8B, 9B, and 10B are cross-sectional diagrams of the pressure chamber plate 2 taken along the B-B line of FIG. 4, and FIGS. 6C, 7C, 8C, 9C, and 10C are cross-sectional diagrams of the pressure chamber plate 2 taken along the C-C line of FIG. 4.

Figure 6A:
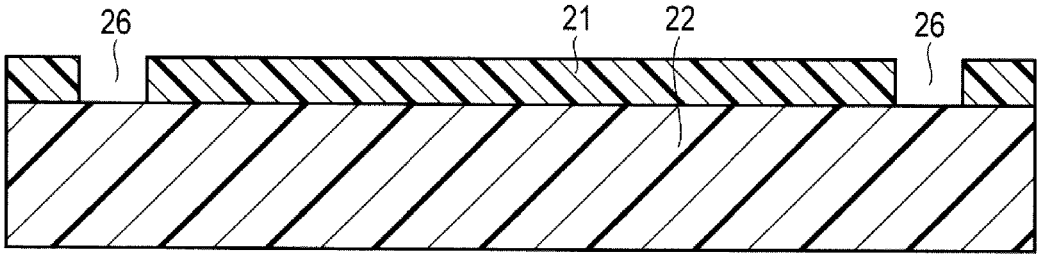
Figure 6B:
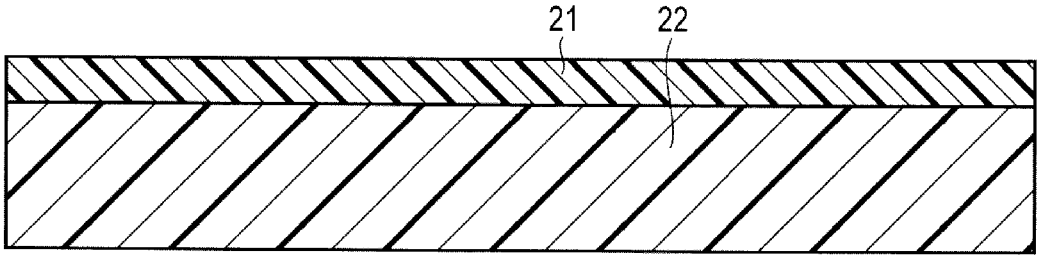
Figure 6C:
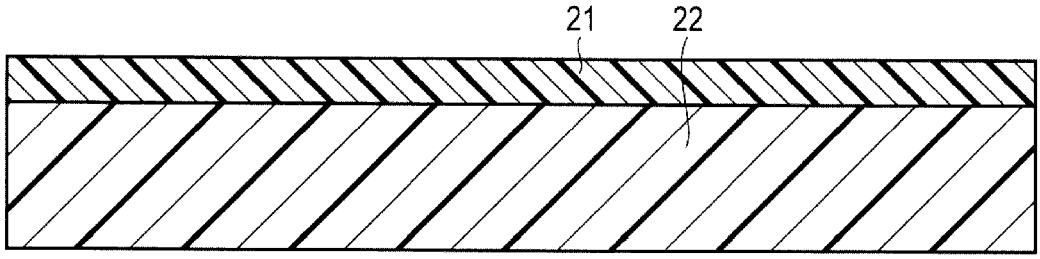

First, as illustrated in FIG. 6A, the through holes 26*a* are formed using dry etching in the diaphragm 21 of silicon thermal oxide, which is formed on the silicon substrate 22. As a result, the surface of the silicon substrate 22 is exposed in the through holes 26*a* except for the portions corresponding to the formation positions of the constricting path 24 and the wiring 74 which are formed in later processes. In FIGS. 6B and 6C, the through holes 26*a* are not formed in the diaphragm 21.

The film of silicon thermal oxide has compressive stress in the intra-surface direction as internal stress. In the present embodiment, since a portion of the internal stress of the diaphragm 21 is released by forming the stress release sections 26 of the through holes 26*a* in the diaphragm 21, the internal stress of the diaphragm 21 is reduced in comparison with a case in which no stress release sections 26 is formed in the diaphragm 21.

Figure 7A:
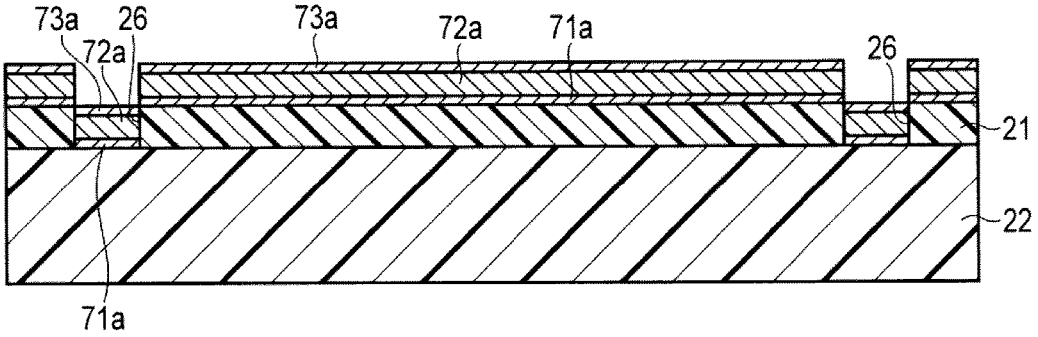
Figure 7B:
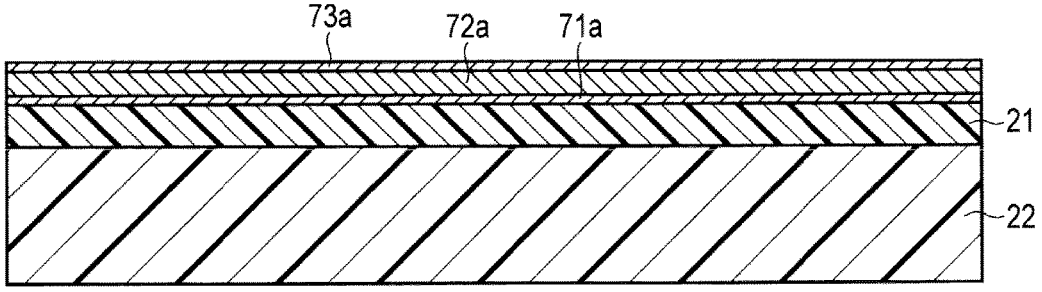
Figure 7C:
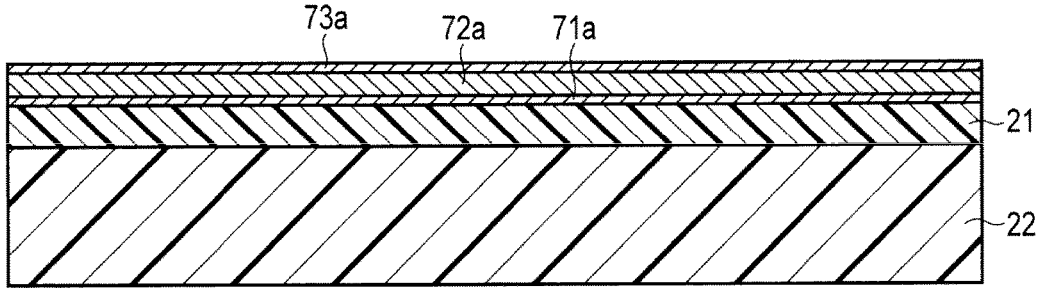

Next, as illustrated in FIGS. 7A to 7C, a bottom conductive film 71*a* serving as the bottom electrode 71, a piezoelectric layer 72*a* serving as the piezoelectric material 72, and a top conductive film 73*a* serving as the top electrode 73 are sequentially formed on the diaphragm 21 by sputtering. For example, it is possible to use the CVD, a sol gel method, aerodeposition (AD), a hydrothermal method or the like as another method of producing the piezoelectric layer 72*a*. At this time, as illustrated in FIG. 7A, even in the through hole 26*a* of the diaphragm 21, the bottom conductive film 71*a*, the piezoelectric layer 72*a*, and the top conductive film 73*a* are formed in the same manner on the surface of the silicon substrate 22.

Examples of materials of the bottom conductive film 71*a* and the top conductive film 73*a* include Pt, Ir, Ni, Cu, Al, Ti, W, Mo, and Au. Examples of materials of the piezoelectric layer 72*a* include PZT, PTO (lead titanate), PMNT, PZNT, ZnO, and AlN. Normally, thicknesses of the bottom conductive film 71*a* and the top conductive film 73*a* are 0.01 μm to 1 μm, and the thickness of the piezoelectric layer 72*a* is 0.1 μm to 10 μm.

Figure 8A:
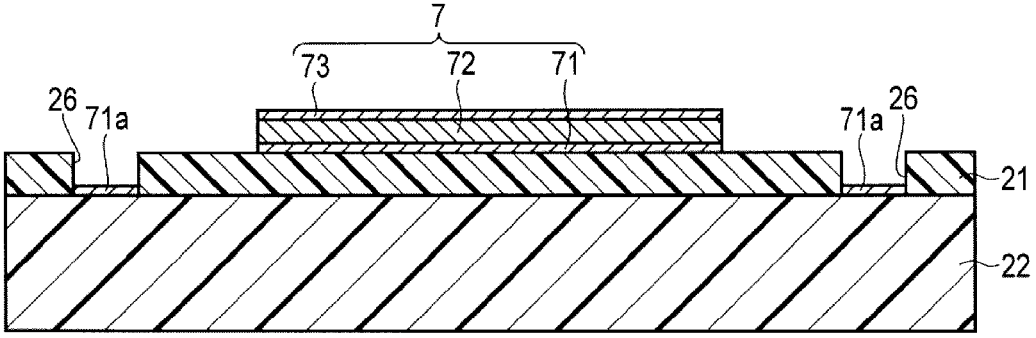
Figure 8B:
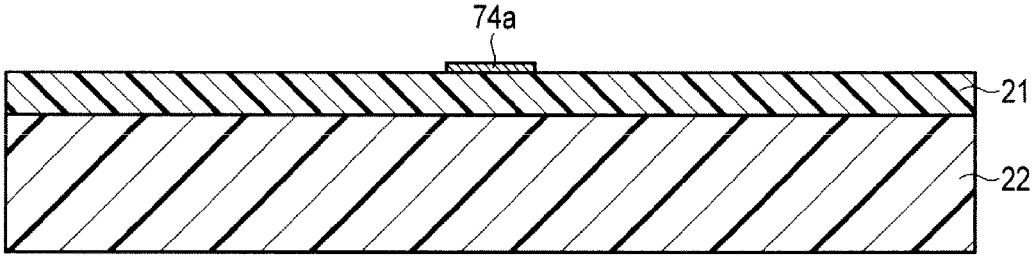
Figure 8C:
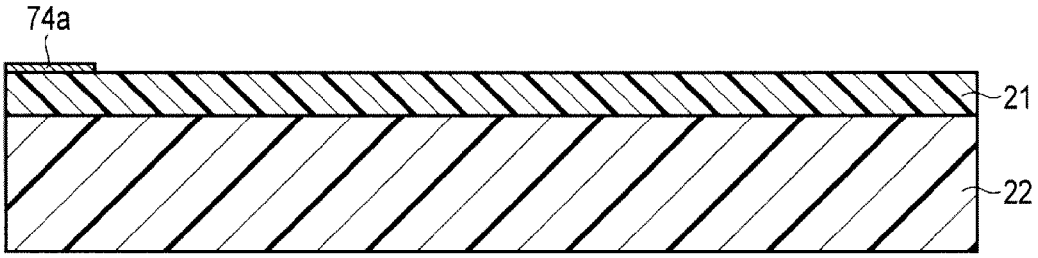

Next, as illustrated in FIGS. 8A to 8C, the top conductive film 73*a*, the piezoelectric layer 72*a*, and the bottom conductive film 71*a* are subjected to dry etching to form the piezoelectric element 7 in the region surrounded by the stress release section 26. During the formation of the piezoelectric element 7, when the bottom conductive film 71*a* is patterned to form the bottom electrode 71, the individual wiring 74*a* is also formed as illustrated in FIGS. 8B and 8C. When the bottom conductive film 71*a* is subjected to dry etching to form the bottom electrode 71, since the silicon substrate 22 may also be etched when the bottom conductive film 71*a* on the bottom surface of the stress release sections 26 is etched, the etching of the bottom conductive film 71*a* is performed using a pattern such that the bottom conductive film 71*a* remains on the bottom surface of the stress release sections 26 as illustrated in FIG. 8A.

Figure 9A:
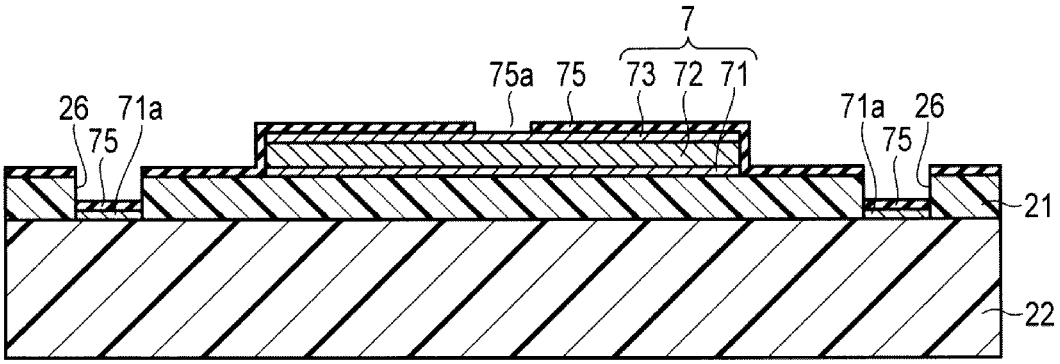
Figure 9B:
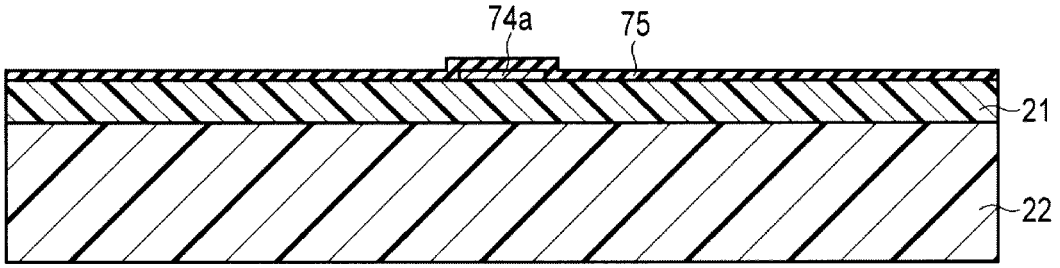
Figure 9C:
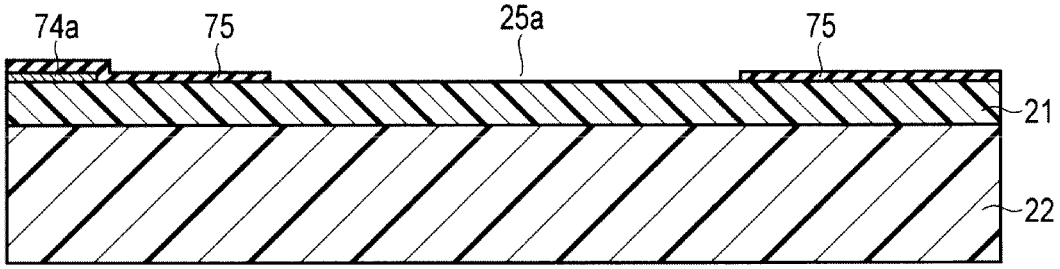

Next, as illustrated in FIGS. 9A to 9C, the insulating film 75 of the silicon oxide film is formed by CVD using TEOS to cover the diaphragm 21 entirely. Next, as illustrated in FIGS. 9A and 9C, the opening 75*b* (FIG. 9A) which exposes a portion of the top electrode 73 and a first opening section 25*b* (FIG. 9C) serving as an opening section of the ink supply chamber 25 are formed by dry etching the insulating film 75. It is possible to use silicon nitride, aluminum oxide, hafnium oxide, or diamond-like carbon (DLC) instead of silicon oxide as the material of the insulating film 75. The thickness of the insulating film 75 is 0.1 μm to 2 μm.

Figure 10A:
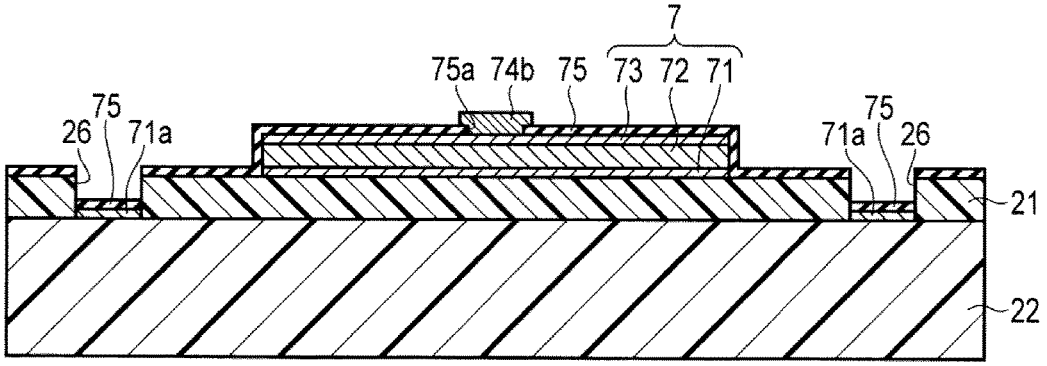
Figure 10B:
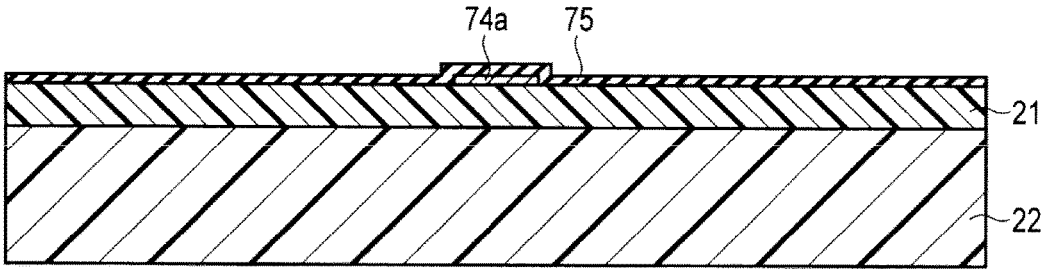
Figure 10C:
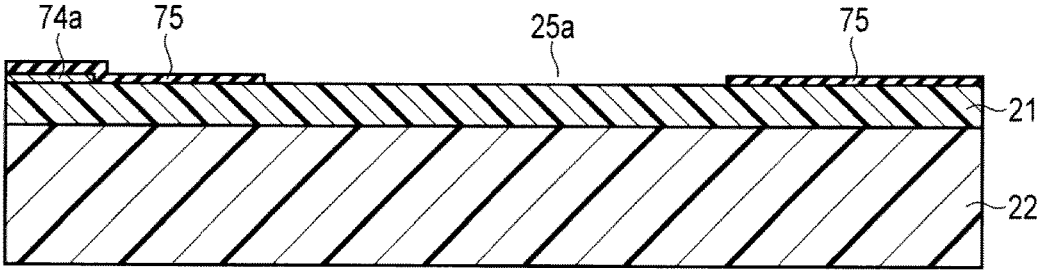

Next, as illustrated in FIGS. 10A to 10C, the conductive film is formed to cover the diaphragm 21 entirely, and the formed conductive film is subjected to wet etching. As a result, the common wiring 74*b* (FIG. 10A) which is connected to the top electrode 73 via the opening 75*b* is formed. Examples of materials of the conductive film include Au, Ir, Ni, Cu, Al, Ti, W, and Mo. The thickness of the common wiring 74*b* is 0.01 μm to 1 μm.

Figure 11A:
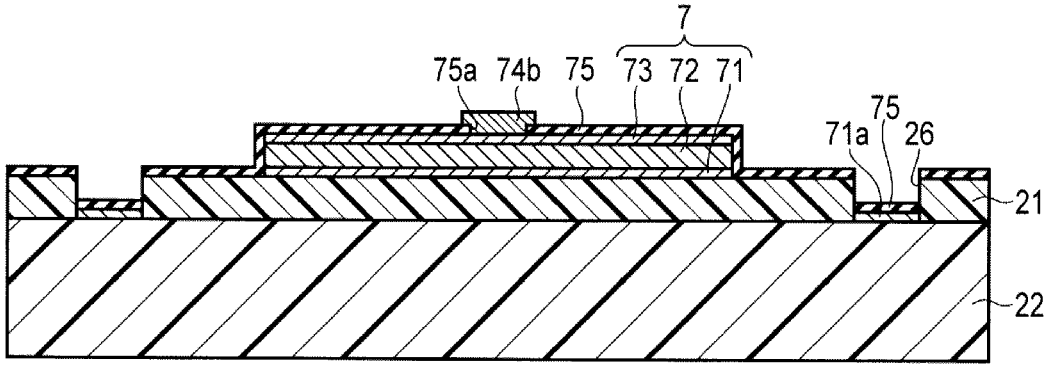
Figure 11B:
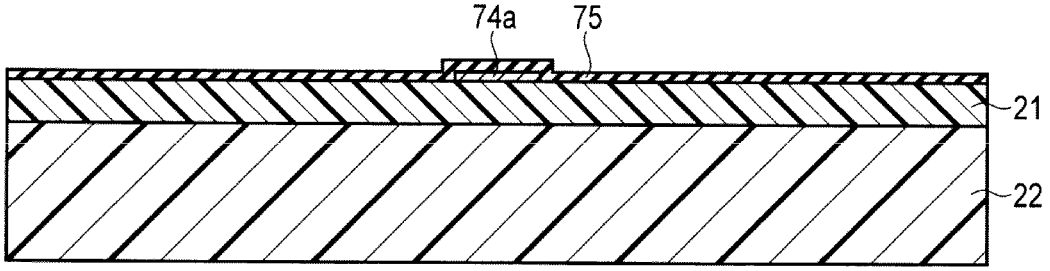
Figure 11C:
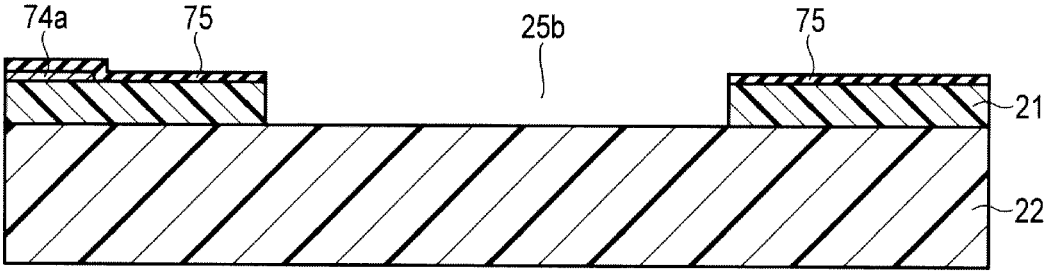

Next, as illustrated in FIG. 11C, the portion of the diaphragm 21 corresponding to the ink supply chamber 25 is removed from the diaphragm 21 using dry etching, and a second opening section 25*b* which serves as a portion of the ink supply chamber 25 is formed in the diaphragm 21.

Figure 12A:
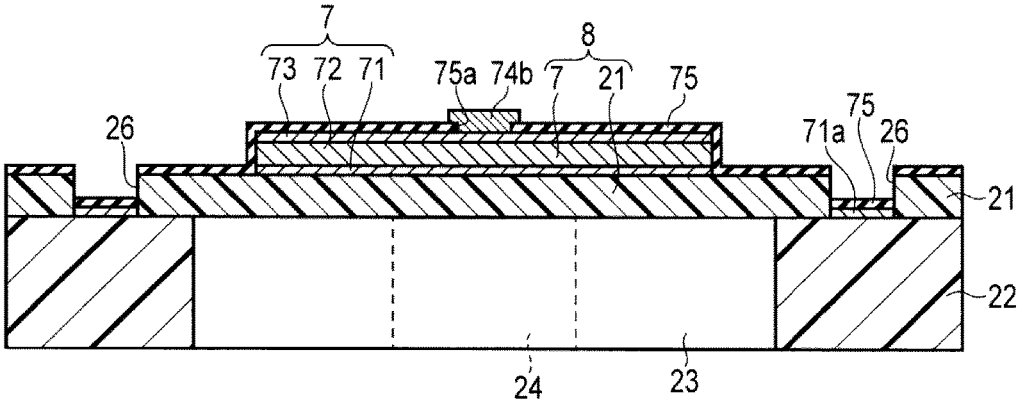
Figure 12B:
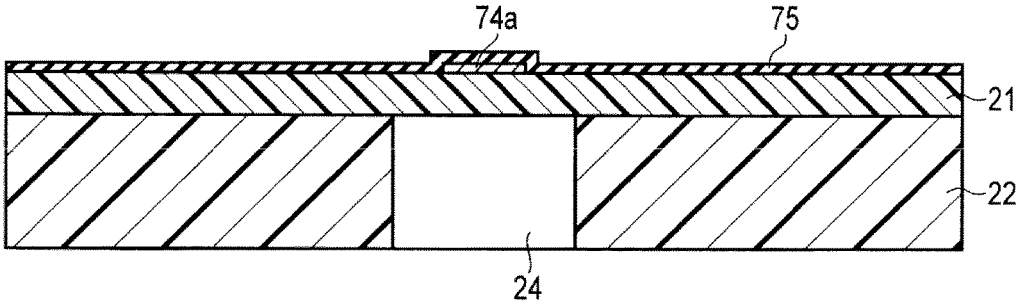
Figure 12C:
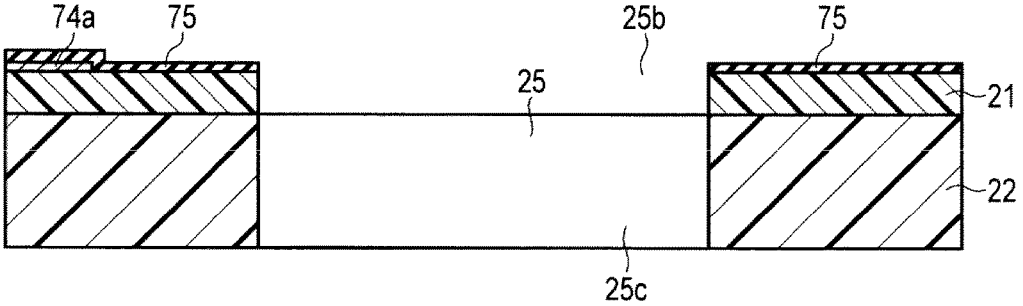

Next, as illustrated in FIG. 12A, the silicon substrate 22 is subjected to dry etching, using the diaphragm 21 as an etch stop, from the side opposite to the diaphragm 21 side of the silicon substrate 22. As a result, the pressure chamber 23 is formed in a position corresponding to the piezoelectric element 7. At the same time, as illustrated in FIG. 12B, the silicon substrate 22 is subjected to dry etching using the diaphragm 21 as an etch stop in the same manner, and the constricting path 24 is also formed. At the same time, as illustrated in FIG. 12C, a third opening section 25*c* which communicates with the second opening section 25*b* of the diaphragm 21 is formed in the silicon substrate 22 using dry etching. In such a way, the ink supply chamber 25 is formed.

When the pressure chamber 23 is formed, an actuator 8 (including the piezoelectric element 7 and the diaphragm 21) deforms to protrude toward the pressure chamber 23 due to the internal stress in the intra-surface direction of the insulating film 75, the piezoelectric element 7, and the diaphragm 21. At this time, since the stress release sections 26 are formed in the diaphragm 21 of the present embodiment, a portion of the compressive stress of the diaphragm 21 is released by the stress release sections 26 and the compressive stress of the diaphragm 21 is reduced. Therefore, the initial deformation of the actuator 8 is small in comparison to a case in which no stress release sections are formed.

Operations of Ink Jet Head

Hereinafter, an operation of the ink jet head 5 will be described. During the operation of the ink jet head 5, electrical power is supplied from the drive circuit section (not illustrated) to the bottom electrode 71 and the top electrode 73. At this time, when an electric field is generated inside the piezoelectric material 72 to distort the piezoelectric element 7, the actuator 8 (the piezoelectric element 7 and the diaphragm 21) deforms due to the interaction between the piezoelectric element 7 and the diaphragm 21. In this case, since the compressive stress of the diaphragm 21 is released by the stress release sections 26, the actuator 8 either does not undergo buckling distortion or the degree of buckling distortion is small, if any. Therefore, variation in the deformation characteristics among the plurality of actuators 8 caused by the buckling distortion of the actuators 8 is suppressed.

When the actuator 8 deforms, the ink inside the pressure chamber 23 is pressurized, and ejected from the nozzle 11. At this time, since the variation in the deformation characteristics among the plurality of actuators 8 is suppressed in the present embodiment, the variation in the ink ejection characteristics among the actuators 8 is low. When the ink is consumed through the ejection, ink (new ink) is supplied to the pressure chamber 23 sequentially via the reservoir 41, the ink supply path 31, the ink supply chamber 25, and the constricting path 24 according to the consumption amount.

Advantages

In the ink jet head 5 according to the present embodiment, the stress release sections 26 for releasing and reducing the compressive stress of the diaphragm 21 are formed in a region of the diaphragm 21 which does not face the pressure chamber 23. Since the compressive stress of the diaphragm 21 is released by the stress release section 26 during the manufacture of the ink jet head 5, it is possible to suppress or reduce the buckling distortion of the actuator 8 when the actuator 8 is driven. Therefore, it is possible to render the deformation characteristics among the plurality of actuators 8 formed in the single ink jet head 5 to be uniform and to render the ink ejection characteristics to be uniform. Therefore, it is possible to provide an ink jet head capable of preventing damage to the actuators 8.

During the manufacturing of the ink jet head 5, the diaphragm 21 is formed on one end surface of the silicon substrate 22. Thereafter, the stress release sections 26 are formed by removing a portion of the diaphragm 21 by forming the through holes 26*a* in a region which does not face the pressure chamber 23 to be formed on the inside of the silicon substrate 22. After forming the stress release sections 26, the piezoelectric element 7 is formed by sequentially stacking the bottom electrode 71, the piezoelectric material 72, and the top electrode 73 on the diaphragm 21. Subsequently, the pressure chamber 23 is formed inside the silicon substrate 22 by etching the silicon substrate 22 from the other end surface side of the silicon substrate 22 which is opposite the one end surface. At this time, the compressive stress of diaphragms 21 is released by the stress release sections 26, the buckling distortion of the actuators 8 when the actuators 8 are driven is suppressed or reduced. As a result, the deformation characteristics among the actuators 8 become more uniform and the ink ejection characteristics become more uniform. It is possible to provide a manufacturing method of an ink jet head capable of preventing damage to the actuators 8 by suppressing or reducing the buckling distortion of the actuators 8.

Second Embodiment

FIGS. 13 to 23B illustrate an ink jet head according to a second embodiment. The present embodiment is a modification example in which the structure of the ink jet head 5 according to the first embodiment (refer to FIGS. 1 to 12C) is modified in the following manner.

Figure 13:
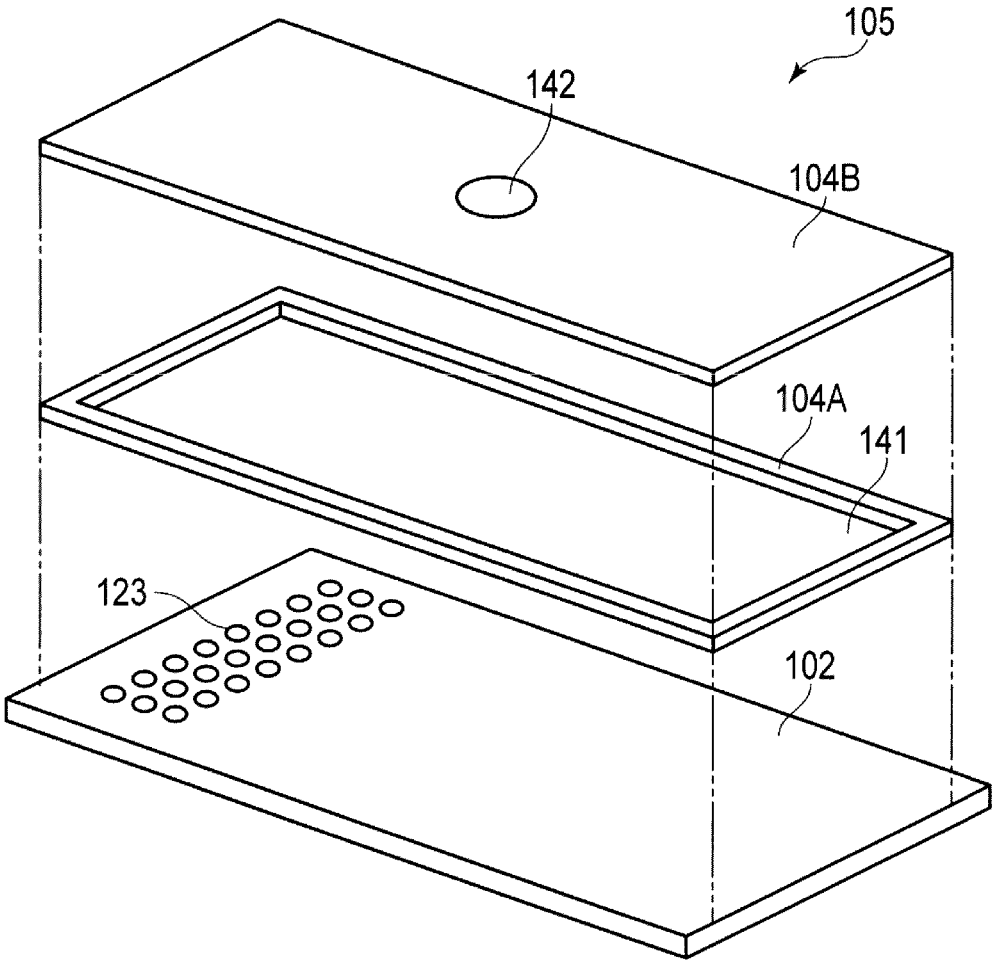
FIG. 13 is an exploded perspective view of an ink jet head according to a second embodiment.

Hereinafter, a structure of an ink jet head 105 according to the present embodiment will be described. FIG. 13 is an exploded perspective view of the ink jet head 105. As illustrated in FIG. 13, the ink jet head 105 according to the present embodiment has a structure in which a pressure chamber plate 102, and reservoir plates 104A and 104B are stacked together. In the present embodiment, the stack of these elements is formed such that a plan shape of each element as viewed from above is rectangular.

Figure 14:
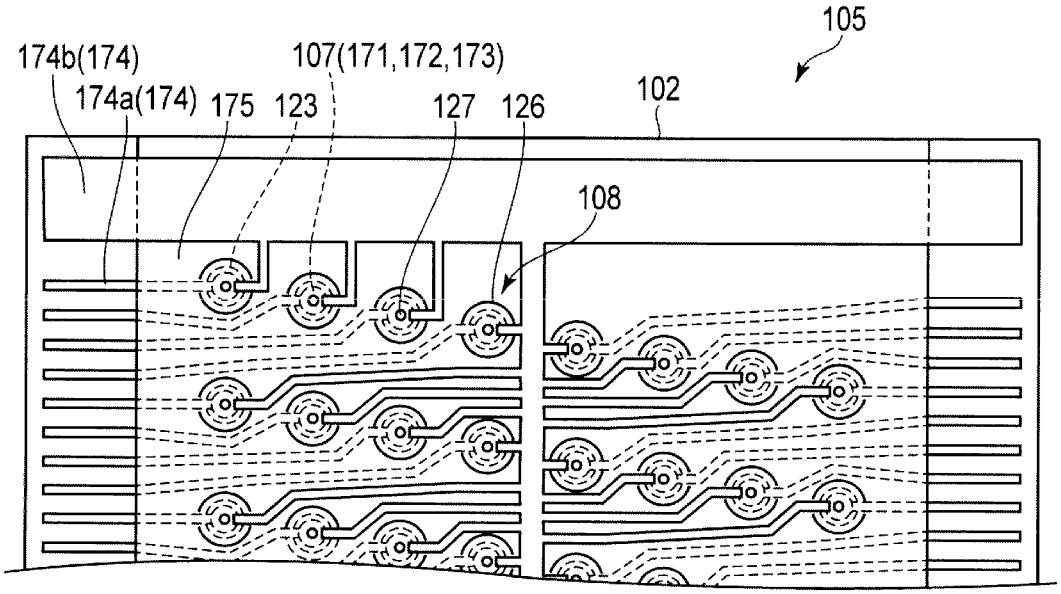
FIG. 14 is a plan view of an end portion of a pressure chamber plate of the ink jet head according to the second embodiment.
Figure 15:
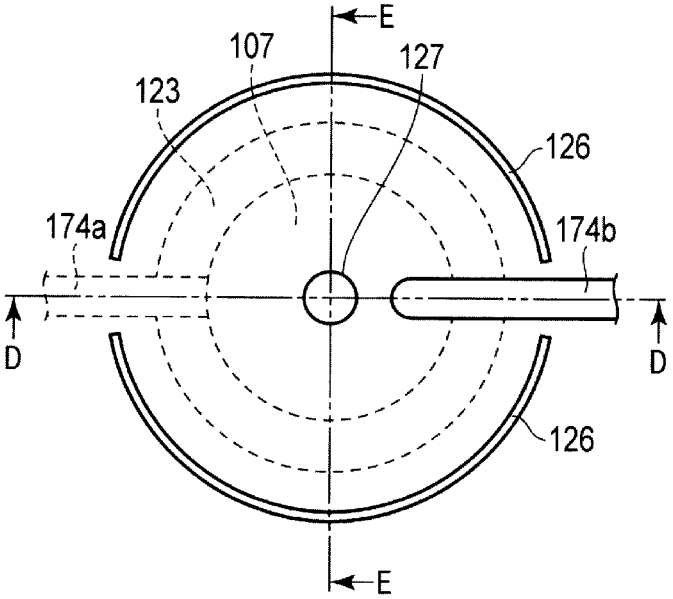
FIG. 15 is an enlarged plan view of a pressure chamber of the ink jet head according to the second embodiment.

FIG. 14 is a plan view of an end portion of the pressure chamber plate 102 of the ink jet head 105. A plurality of pressure chambers 123 is formed in the pressure chamber plate 102. As illustrated in FIGS. 14 and 15, the pressure chamber 123 according to the present embodiment is cylindrical.

Figure 16A:
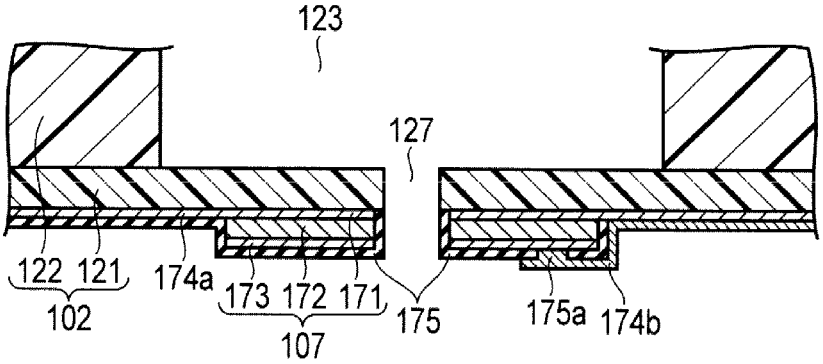
FIGS. 16A and 16B are cross-sectional views of the pressure chamber of the ink jet head of FIG. 15 according to the second embodiment, where FIGS. 16A and 16B correspond to a portion taken along a D-D line and an E-E line, respectively.
Figure 16B:
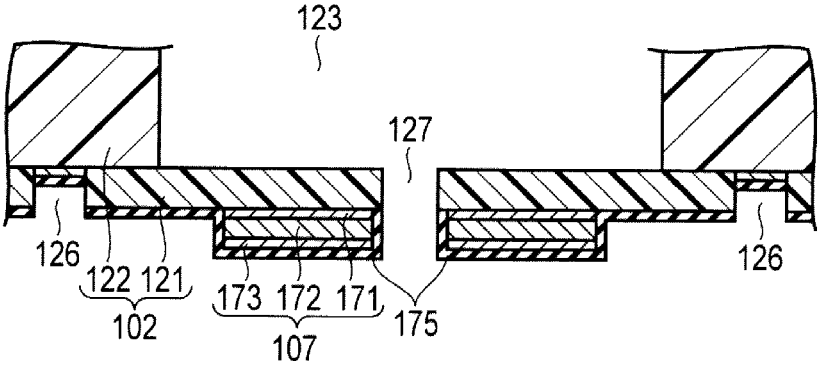

FIG. 15 is an enlarged view of one of the pressure chambers 123 of FIG. 14, FIG. 16A is a cross-sectional view of the pressure chamber 123 taken along the line D-D of FIG. 15, and FIG. 16B is a cross-sectional view of the pressure chamber 123 taken along the line E-E of FIG. 15. As illustrated in FIGS. 16A and 16B, the pressure chamber plate 102 includes a silicon substrate 122 which is covered with a diaphragm 121 of silicon thermal oxide.

Normally, the thickness of the pressure chamber plate 102 is 50 μm to 500 μm, and the thickness of the silicon thermal oxide film (the diaphragm 121) is 0.2 μm to 10 μm. For the diaphragm 121, a zirconium oxide film, an iridium oxide film, a ruthenium oxide film, or the like may be used instead of a silicon thermal oxide film. For example, when the zirconium oxide film is used, it is possible to form the zirconium oxide film by thermally oxidizing a zirconium film after the zirconium film is formed on the silicon substrate 122 by sputtering.

On a surface of the pressure chamber plate 102 on which the pressure chambers 123 are opened, the reservoir plates 104A and 104B are stacked via an epoxy adhesive, for example. A reservoir 141 which is joined to the pressure chambers 123 by the reservoir plate 104A is formed, and an ink inlet 142 for supplying the ink to the reservoir 141 is formed in the reservoir plate 104B. For the materials of the reservoir plates 104A and 104B, alumina, zirconia, silicon carbide, silicon nitride, barium titanate, and the like are given as examples of ceramic materials, stainless steel, aluminum, and titanium are given as examples of metal materials, and ABS, polyacetal, polyamide, polycarbonate, polyether sulfone, and the like are examples of resin materials.

A piezoelectric element 107 is disposed at a position of the diaphragm 121 corresponding to the pressure chamber 123. The piezoelectric element 107 has a structure in which a bottom electrode 171, a piezoelectric body 172, and a top electrode 173 are stacked together. A through hole penetrating through the diaphragm 121 and the piezoelectric element 107 is formed at axial centers thereof, and the through hole forms a nozzle 127 which is connected to the pressure chamber 123.

As illustrated in FIGS. 14, 15, and 16A, the bottom electrode 171 is connected to individual wiring 174*a*, and the individual wiring 174*a* extends to the end portion of the pressure chamber plate 102. The top electrode 173 is connected to common wiring 174*b* via an opening 175*b* of an insulating film 175 of the silicon oxide film, and the common wiring 174*b* also extends to the end portion of the pressure chamber plate 102. A wiring 174 which includes the individual wiring 174*a* and the common wiring 174*b* is connected to connection terminals of a drive circuit section (not illustrated) at the end portion of the pressure chamber plate 102.

As illustrated in FIGS. 15 and 16B, a pair of substantially semicircular stress release sections 126 is formed in a groove shape in the diaphragm 121 for each of the piezoelectric elements 107 so as to surround the pressure chamber 123. The stress release sections 126 are formed in the same shape as the piezoelectric elements 107 except for the portion corresponding to the wiring 174. Here, the pull-out position and the pull-out direction of the wiring 174 corresponding to each of the piezoelectric elements 107 are matched such that it is easy to render the shape of each of the stress release sections 126 corresponding to each of the piezoelectric elements 107 to be the same shape.

Manufacture of Pressure Chamber Plate 102 and Piezoelectric Element 107

Hereinafter, a manufacturing process of the pressure chamber plate 102 and the piezoelectric element 107 will be described. FIGS. 17A, 18A, 19A, 20A, 21A, 22A, and 23A are cross-sectional diagrams of the pressure chamber plate 102 and the piezoelectric element 107 taken along the D-D line of FIG. 15. In the same manner, FIGS. 17B, 18B, 19B, 20B, 21B, 22B, and 23B are cross-sectional diagrams of the pressure chamber plate 102 and the piezoelectric element 107 taken along the E-E line of FIG. 15.

Figure 17A:
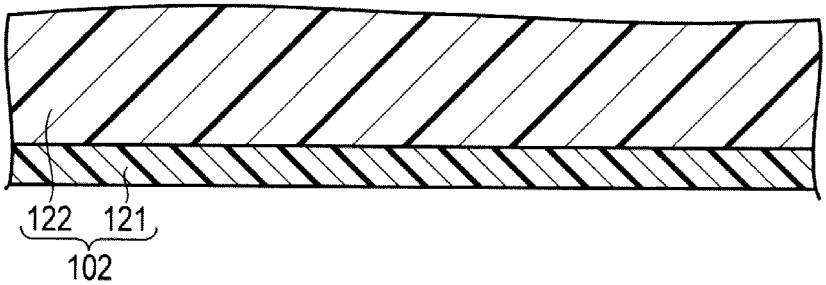
Figure 17B:
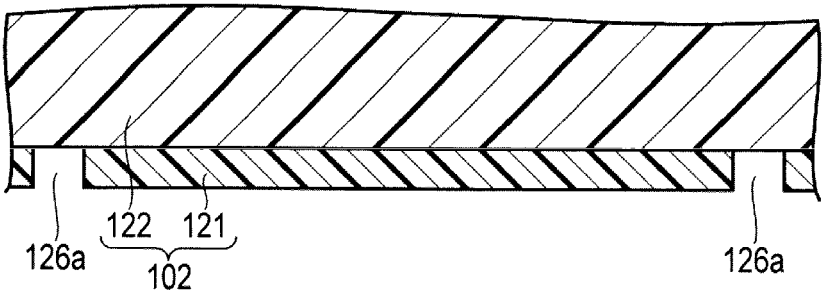

First, as illustrated in FIG. 17B, through holes 126*a* are formed using dry etching in the diaphragm 121 of silicon thermal oxide. As a result, the surface of the silicon substrate 122 is exposed in the through holes 126*a* except for the portions corresponding to positions of the wiring 174 to be formed in a later process. In FIG. 17A, the through holes 126*a* are not formed in the diaphragm 121.

The silicon thermal oxide film (diaphragm 121) has compressive stress in the intra-surface direction as internal stress. In the present embodiment, since a portion of the internal stress of the diaphragm 121 is released by forming the stress release sections 126 of the through holes 126*a* in the diaphragm 121, the internal stress of the diaphragm 121 is reduced in comparison with a case in which no stress release section is formed in the diaphragm 121.

Figure 18A:
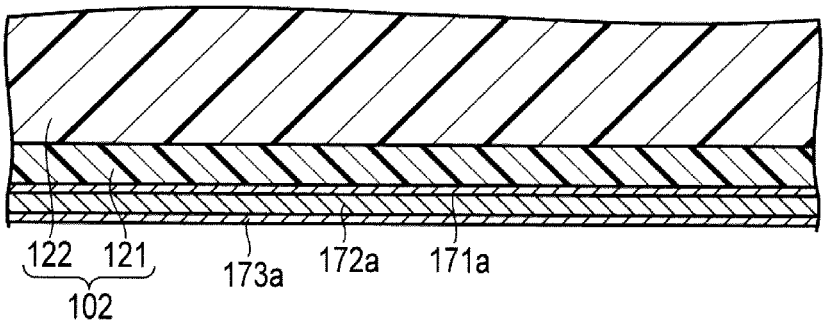
Figure 18B:
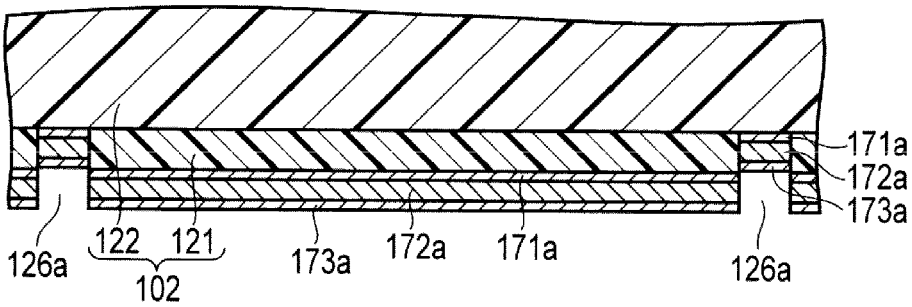

Next, as illustrated in FIGS. 18A and 18B, a bottom conductive film 171*a* serving as the bottom electrode 171, a piezoelectric layer 172*a* serving as the piezoelectric body 172, and a top conductive film 173*a* serving as the top electrode 173 are sequentially formed on the diaphragm 121 by sputtering. It is possible to use the CVD, a sol gel method, aerodeposition (AD), a hydrothermal method or the like as another method for forming the piezoelectric layer 172*a*. At this time, as illustrated in FIG. 18B, even in the through hole 126*a*, the bottom conductive film 171*a*, the piezoelectric layer 172*a*, and the top conductive film 173*a* are formed in the same manner on the surface of the silicon substrate 122.

Examples of materials of the bottom conductive film 171*a* and the top conductive film 173*a* include Pt, Ir, Ni, Cu, Al, Ti, W, Mo, and Au. Examples of materials of the piezoelectric layer 172*a* include PZT, PTO (lead titanate), PMNT, PZNT, ZnO, and AlN. Normally, the thicknesses of the bottom conductive film 171*a* and the top conductive film 173*a* are 0.01 μm to 1 μm, and the thickness of the piezoelectric layer 172*a* is 0.1 μm to 10 μm.

Figure 19A:
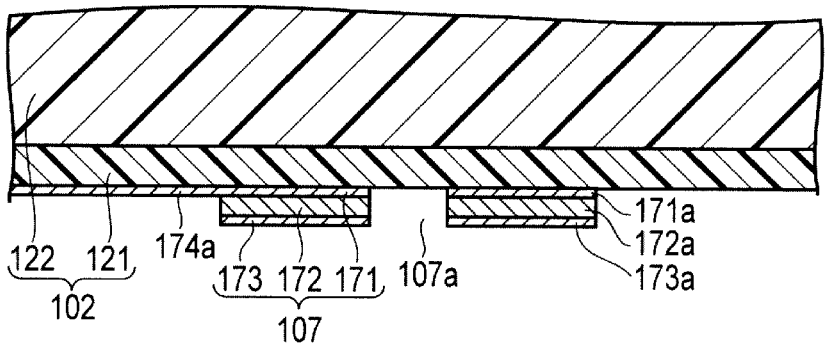
Figure 19B:
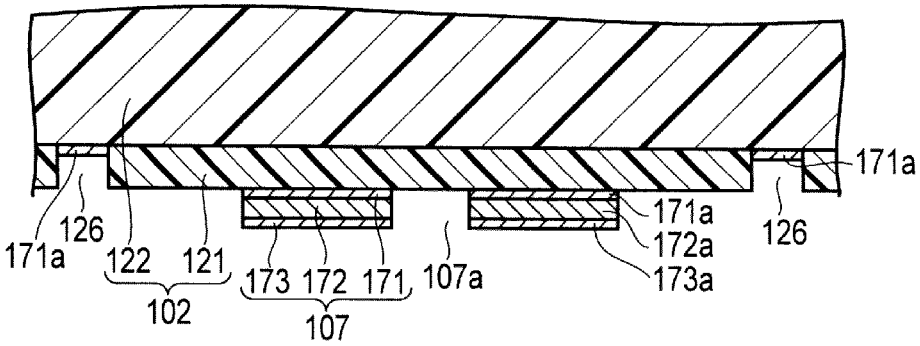

Next, as illustrated in FIGS. 19A and 19B, the top conductive film 173*a*, the piezoelectric layer 172*a*, and the bottom conductive film 171*a* are subjected to dry etching to form the donut-shaped piezoelectric element 107 having a through hole 107*a* in the region surrounded by the stress release section 126. During the formation of the piezoelectric element 107, when the bottom conductive film 171*a* is patterned to form the bottom electrode 171, the individual wiring 174*a* is also formed. If the bottom conductive film 171*a* of the stress release sections 126 is etched while the bottom conductive film 171*a* is subjected to dry etching to form the bottom electrode 171, the silicon substrate 122 may also be etched. To prevent the etching of the silicon substrate 122, the etching of the bottom conductive film 171*a* is performed using a pattern such that the bottom conductive film 171*a* remains on the bottom surface of the stress release sections 126.

Figure 20A:
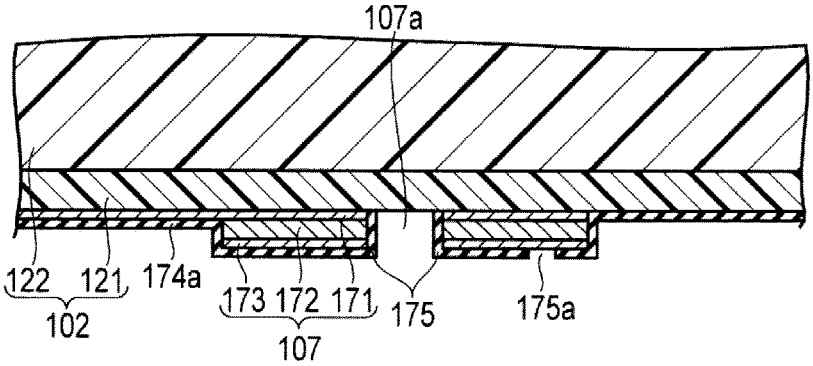
Figure 20B:
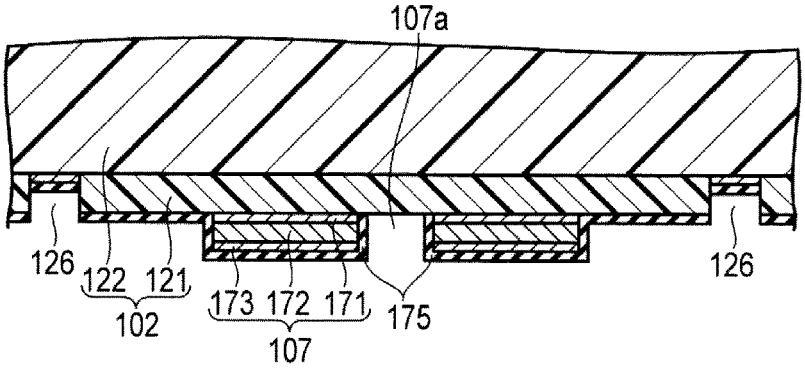

Next, as illustrated in FIGS. 20A and 20B, the insulating film 175 of silicon oxide is formed by CVD using TEOS so as to cover the diaphragm 121 entirely. Next, as illustrated in FIG. 20A, the opening 175*b* which exposes a portion of the top electrode 173 is formed by dry etching the insulating film 175. It is possible to use silicon nitride, aluminum oxide, hafnium oxide, or diamond-like carbon (DLC) instead of the silicon oxide film as the material of the insulating film 175. The thickness of the insulating film 175 is 0.1 μm to 2 μm.

Figure 21A:
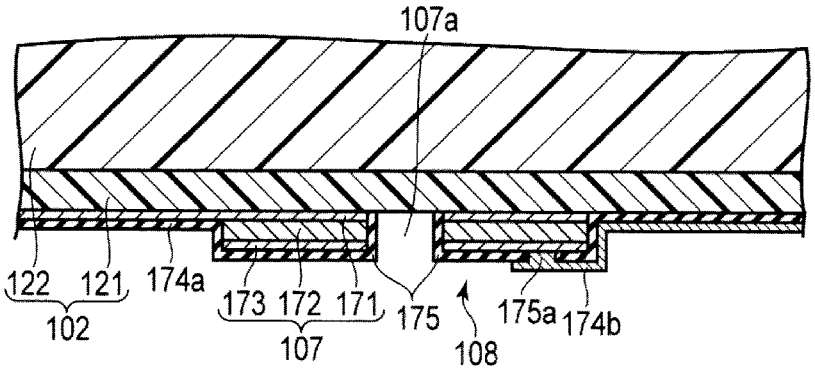
Figure 21B:
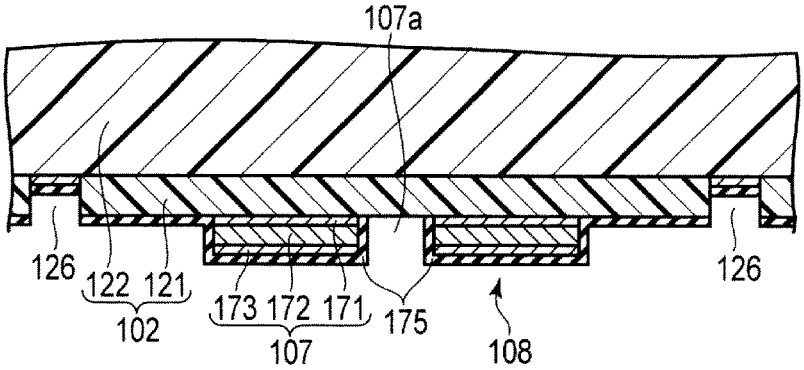

Next, as illustrated in FIG. 21A, the conductive film is formed to cover the diaphragm 121 entirely, and the formed conductive film is subjected to wet etching. As a result, the common wiring 174*b* which is connected to the top electrode 173 via the opening 175*b* is formed. Examples of materials of the conductive film include Au, Ir, Ni, Cu, Al, Ti, W, and Mo. The thickness of the common wiring 174*b* is 0.01 μm to 1 μm.

Figure 22A:
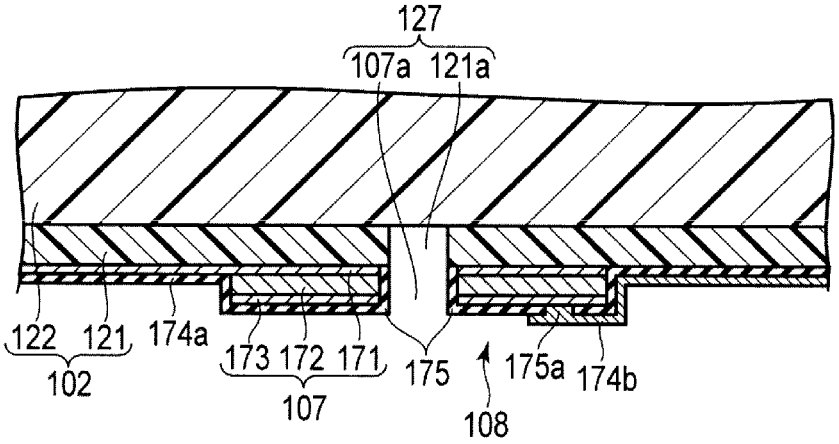
Figure 22B:
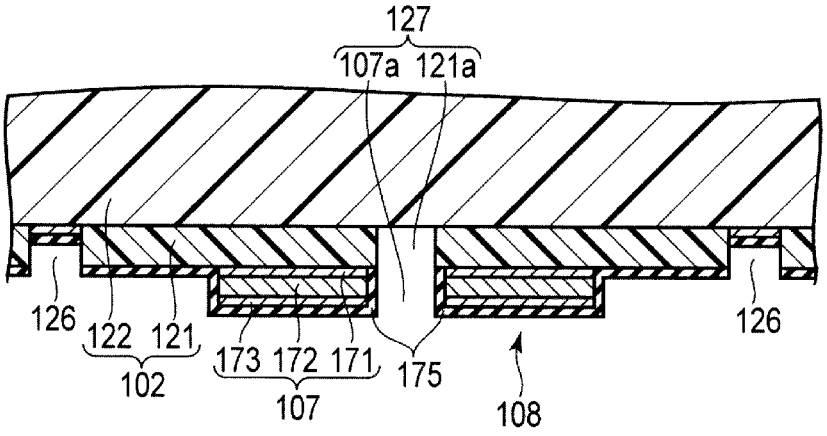

Next, as illustrated in FIGS. 22A and 22B, a through hole 121*a* connected to the through hole 107*a* of the piezoelectric element 107 is formed in the diaphragm 121 by dry etching, and the nozzle 127 is formed as a result.

Figure 23A:
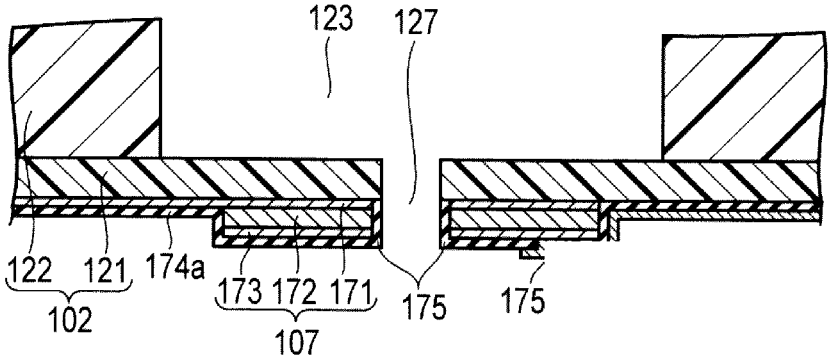
Figure 23B:
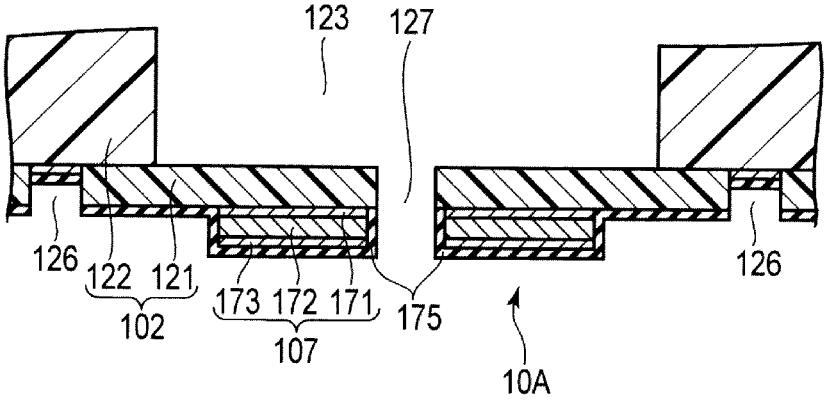

Next, as illustrated in FIGS. 23A and 23B, the silicon substrate 122 is subjected to dry etching, using the diaphragm 121 as an etch stop, from the side opposite to the diaphragm 121 of the silicon substrate 122, and the pressure chamber 123 is formed in a position corresponding to the piezoelectric element 107. When the pressure chamber 123 is formed, an actuator 108 (the piezoelectric element 107 and the diaphragm 121) deforms to protrude toward the pressure chamber 123 due to the internal stress in the intra-surface direction of the insulating film 175, the piezoelectric element 107, and the diaphragm 121. At this time, the stress release sections 126 are formed in the diaphragm 121 in the present embodiment, a portion of the compressive stress of the diaphragm 121 is released by the stress release sections 126 and the compressive stress of the diaphragm 121 is reduced. Therefore, the initial deformation of the actuator 108 is small in comparison to a case in which no stress release section is formed.

Operations of Ink Jet Head

Hereinafter, an operation of the ink jet head 105 will be described. During the operation of the ink jet head 105, electrical power is supplied from the drive circuit section (not illustrated) to the bottom electrode 171 and the top electrode 173. At this time, when an electric field is generated inside the piezoelectric body 172 to distort the piezoelectric element 107, the actuator 108 (the piezoelectric element 107 and the diaphragm 121) deforms due to the interaction between the piezoelectric element 107 and the diaphragm 121. In this case, since the compressive stress of the diaphragm 121 is released by the stress release sections 126, the actuator 108 either does not undergo buckling distortion or the degree of buckling distortion is small, if any. Therefore, variation in the deformation characteristics among the plurality of actuators 108 caused by the buckling distortion is suppressed.

When the actuator 108 deforms, the ink inside the pressure chamber 123 is pressurized and ejected from the nozzle 127. At this time, since the variation in the deformation characteristics among the plurality of actuators 108 is suppressed in the present embodiment, the variation in the ink ejection characteristics among the actuators 108 is low. When the ink is consumed through the ejection, ink (new ink) is supplied to the pressure chamber 123 from the reservoir 141 according to the consumption amount.

Advantages and Effects

According to the present embodiment, a pair of substantially semicircular stress release sections 126 is formed in a groove shape in the diaphragm 121 for each of the piezoelectric elements 107 so as to surround the pressure chambers 123. Since a portion of the internal stress of the diaphragm 121 is released, the internal stress of the diaphragm 121 is reduced in comparison with a case in which the stress release sections 126 are not formed in the diaphragm 121. Therefore, it is possible to suppressor to reduce the buckling distortion of the actuator 108 when the compressive stress of the diaphragm 121 is released and the actuator 108 is driven. Accordingly, it is possible to cause the deformation characteristics among the plurality of actuators 108 to be more uniform and the ink ejection characteristics to be more uniform. As a result, it is possible to provide the ink jet head 105 capable of preventing damage to the actuators 108.

During the manufacturing of the ink jet head 105, the diaphragm 121 is formed on one end surface of the silicon substrate 122. Thereafter, the stress release sections 126 are formed by removing a portion of the diaphragm 121 by forming the through holes 126*a* in a region which does not face the pressure chamber 123 to be formed on the inside of the silicon substrate 122. After forming the stress release sections 126 of the diaphragm 121, the piezoelectric element 107 is formed by sequentially stacking the bottom electrode 171, the piezoelectric body 172, and the top electrode 173 on the diaphragm 121. Subsequently, the pressure chamber 123 is formed inside the silicon substrate 122 by etching the silicon substrate 122 from the other end surface of the silicon substrate 122 which is opposite the one end surface. At this time, the compressive stress of diaphragms 121 is released by the stress release sections 126, the buckling distortion of the actuators 108 when the actuators 108 are driven is suppressed or reduced, and thus, the deformation characteristics among the actuators 108 become more uniform and the ink ejection characteristics become more uniform. It is possible to provide a manufacturing method of an ink jet head capable of preventing damage to the actuators 108 by suppressing or reducing the buckling distortion of the actuators 108.

Modification Example

Figure 24A:
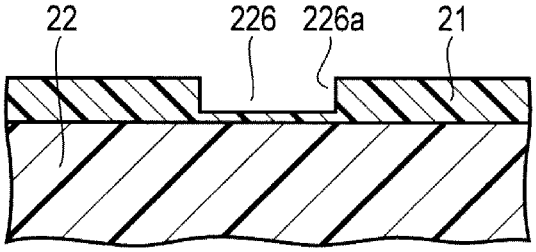
FIGS. 24A to 24C illustrate a pressure chamber plate according to first, second, and third modification examples, respectively.

FIG. 24A illustrates a pressure chamber plate according to a first modification example of the first embodiment (refer to FIGS. 1 to 12C). In the first embodiment, during the formation of the stress release section 126, the through hole 26*a* is formed in the diaphragm 21, and the surface of the silicon substrate 22 is exposed from the bottom surface of the stress release section (the removed section) 26. In the present modification example, by half etching the diaphragm 21, a non-penetrating recessed section 226*a* is formed in the diaphragm 21 as illustrated in FIG. 24A, and a stress release section 226 (a removed section) in which a portion of the diaphragm 21 is removed is formed. In this case, it is possible to ensure that the surface of the silicon substrate 22 is not exposed from the bottom surface of the stress release section 226.

When the silicon oxide film remains on the bottom surface of the stress release section 26 according to the first modification example, in the dry etching of the bottom conductive film 71*a*, the silicon oxide film serves as a protective film of the silicon substrate 122. Therefore, when the bottom conductive film 71*a* remains on the bottom surface of the stress release section 26 as in the first embodiment, during the dry etching of the bottom conductive film 71*a*, the bottom conductive film 71*a* on the bottom surface of the stress release section 26 can be removed, and the bottom conductive film 71*a* may not remain on the bottom surface of the stress release section 26.

Figure 24B:
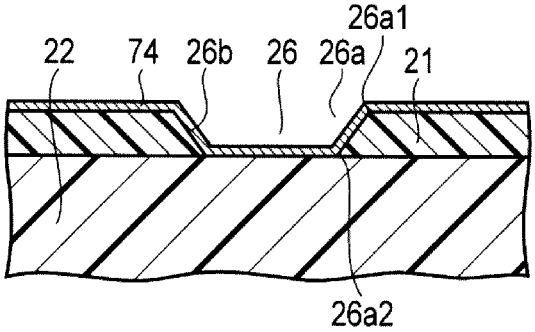

FIG. 24B illustrates a pressure chamber plate according to a second modification example of the first embodiment. In the ink jet head 5 according to the first embodiment, the stress release section 26 is not formed on the portion of the diaphragm 21 corresponding to the wiring 74 (the wiring 74 is not formed on the stress release section 26).

In comparison, in the present modification example, a tapered section 26*b* is provided on the circumferential wall surface of the through hole 26*a* of the diaphragm 21 as illustrated in FIG. 24B. The tapered section 26*b* is shaped such that an outside opening edge 26*a*1 of the through hole 26*a* is opened wider than an inside opening edge 26*a*2 of the through hole 26*a*. The tapered section 26*b* is provided on the circumferential wall surface of the through hole 26*a* in this manner, and the wiring 74 is provided on a portion of the tapered section 26*b* of the through hole 26*a*. Accordingly, it is possible to reduce the risk of disconnection caused by the level difference in the wiring 74 in comparison to a case in which the tapered section 26*b* is not provided on the circumferential wall surface of the through hole 26*a*.

When the non-penetrating recessed section 226*a* is formed in the diaphragm 21 as illustrated in FIG. 24A, the tapered section 26*b* may be provided on the circumferential wall surface of the recessed section 226*a* and the wiring 74 may be provided on a portion of the tapered section 26*b* of the recessed section 226*a*.

Figure 24C:
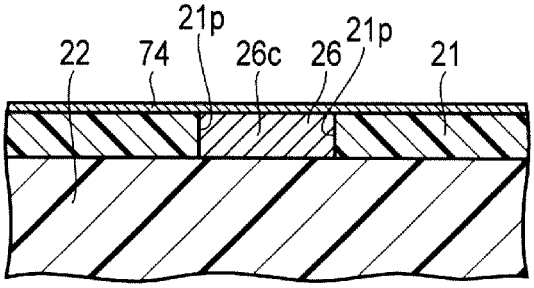

FIG. 24C illustrates a pressure chamber plate according to a third modification example of the first embodiment. In the first embodiment, the stress release section 26 is a space. In the present modification example, after forming the stress release section 26, the stress release section 26 is filled with a filler capable of forming a filler section 26*c* in which the internal stress is tensile stress. The filler is formed of, for example, polyimide. The filler section 26*c* that has the tensile stress is formed by, for example, applying a layer of photosensitive polyimide, and exposing and developing the layer of polyimide so that the filler remains in the stress release section 26. In this case, an end surface 21*p* of the diaphragm 21 is pulled by the tensile stress of the filler section 26*c*. Therefore, the internal compressive stress of the diaphragm 21 is released further and the internal stress of the diaphragm 21 is further reduced in comparison to a case in which the stress release section 26 is a space. Since the stress release section 26 is filled with the filler, even when the stress release section 26 is formed in a portion of the diaphragm 21 corresponding to the wiring 74, level differences are less likely to be formed in the wiring 74. Therefore, there is few risk of disconnection.

In the first embodiment, the stress release section 26 has a groove shape; however, as long as it is possible to release the internal stress of the diaphragm 21 facing the piezoelectric element 7, it is possible to freely set the number, position, shape, and the like of the stress release section 26. For example, in the second embodiment (refer to FIGS. 13 to 23B), it is possible to remove portions of the diaphragm 121 except for the portion corresponding to the wiring 174 and the pressure chamber 123.

According to the above embodiments, the compressive stress of diaphragms is released by the stress release sections, and the buckling distortion of the actuators when the actuators are driven is suppressed or reduced. As a result, the deformation characteristics among the actuators become more uniform and the ink ejection characteristics become more uniform. It is possible to provide an ink jet head and a manufacturing method thereof capable of preventing damage to the actuators by suppressing or reducing the buckling distortion of the actuators.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An ink jet head, comprising:

a base member having a plurality of openings;

a diaphragm formed on a surface of the base member covering each of the openings, a pressure chamber being formed at each of the openings; and a plurality of piezoelectric elements formed at locations on the diaphragm corresponding to the pressure chambers, each of the piezoelectric elements being configured to deform the diaphragm to cause liquid to be ejected from a corresponding pressure chamber, wherein the diaphragm includes a plurality of stress release portions that reduces compressive residual stress in the diaphragm, each of the stress release portions having a curved shape and corresponding to one of the piezoelectric elements.

2. The ink jet head according to claim 1, further comprising:

a wiring extending along a surface of the base member and connected to the piezoelectric elements, wherein the stress release portions are not formed on a region of the diaphragm corresponding to a region of the base member along which the wiring extends.

3. The ink jet head according to claim 1, wherein each of the stress release portions is formed along a periphery of the corresponding pressure chamber.

4. The ink jet head according to claim 1, wherein each of the stress release portions includes a slit that penetrates the diaphragm.

5. The ink jet head according to claim 4, wherein the slit has a tapered side wall.

6. The ink jet head according to claim 4, wherein each of the stress release portions is filled with a filler.

7. The ink jet head according to claim 1, wherein each of the stress release portions includes a recessed portion at which a thickness of the diaphragm is smaller than a surrounding portion of the diaphragm.

8. The ink jet head according to claim 1, further comprising:

a nozzle plate formed on a surface of the base member that is opposite to the surface on which the diaphragm is formed, the nozzle plate including a plurality of nozzles, each of which is connected to one of the pressure chambers.

9. The ink jet head according to claim 1, wherein the diaphragm includes a plurality of nozzles, each of which is connected to one of the pressure chambers.

10. The ink jet head according to claim 1, wherein at least two of the stress release portions are disposed in correspondence with each of the piezoelectric elements.

11. The ink jet head according to claim 1, further comprising:

a wiring extending over at least one of the stress release portions of the diaphragm and connected to one of the piezoelectric elements corresponding to said one of the stress release portions.

12. An ink jet head, comprising:

a base member having a plurality of openings;

a diaphragm formed on a surface of the base member covering each of the openings, a pressure chamber being formed at each of the openings; and a plurality of piezoelectric elements formed at locations on the diaphragm corresponding to the pressure chambers, each of the piezoelectric elements being configured to deform the diaphragm to cause liquid to be ejected from a corresponding pressure chamber by causing deformation of the diaphragm, wherein the diaphragm has compressive residual stress therein, and includes a plurality of slits or recessed portions corresponding to the plurality of piezoelectric elements, each of the slits or recessed portions having a curved shape.

13. The ink jet head according to claim 12, further comprising:

a wiring extending along a surface of the base member and connected to the piezoelectric elements, wherein the slits or the recessed portions are not formed on a region of the diaphragm corresponding to a region of the base member along which the wiring extends.

14. The ink jet head according to claim 12, wherein each of the slits or the recessed portions is formed along a periphery of the corresponding pressure chamber.

15. The ink jet head according to claim 12, wherein the diaphragm includes the plurality of slits, and each of the slits penetrates the diaphragm.

16. The ink jet head according to claim 12, wherein the diaphragm includes the plurality of recessed portions, and a thickness of the diaphragm at each of the recessed portions is smaller than a surrounding portion of the diaphragm.

17. The ink jet head according to claim 12, wherein each of the slits or the recessed portions has a tapered side wall.

18. The ink jet head according to claim 12, wherein each of the slits or the recessed portions is filled with a filler.

19. The ink jet head according to claim 12, further comprising:

a nozzle plate formed on a surface of the base member that is opposite to the surface on which the diaphragm is formed, the nozzle plate including a plurality of nozzles, each of which is connected to one of the pressure chambers.

20. The ink jet head according to claim 12, wherein the diaphragm includes a plurality of nozzles, each of which is connected to one of the pressure chambers.

* * * * *